US007669963B2

(12) United States Patent
Brookmire et al.

(10) Patent No.: US 7,669,963 B2
(45) Date of Patent: Mar. 2, 2010

(54) MULTI-CARRIAGE PRINTING DEVICE AND METHOD

(75) Inventors: Michael Brookmire, Vancouver, WA (US); Weiyun Sun, Vancouver, WA (US); Hsue-Yang Liu, Vancouver, WA (US); Anthony Carcia, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 728 days.

(21) Appl. No.: 11/495,075

(22) Filed: Jul. 28, 2006

(65) Prior Publication Data

US 2008/0024551 A1 Jan. 31, 2008

(51) Int. Cl.
*B41J 29/00* (2006.01)
*B41J 29/38* (2006.01)
*B41J 29/393* (2006.01)

(52) U.S. Cl. ..... 347/37; 347/5; 347/19

(58) Field of Classification Search ..... 347/37, 347/19, 5

See application file for complete search history.

(56) References Cited

U.S. PATENT DOCUMENTS

| | | | | |
|---|---|---|---|---|
| 5,585,825 | A | 12/1996 | Kneezel et al. | |
| 6,042,220 | A | 3/2000 | Wakahara et al. | |
| 6,352,326 | B1 | 3/2002 | Maeda | |
| 6,619,794 | B2 | 9/2003 | Wade | |
| 6,637,958 | B2 | 10/2003 | Smith | |
| 6,708,279 | B1 | 3/2004 | Takenaka | |
| 6,820,955 | B1 | 11/2004 | Usui | |
| 7,025,432 | B2 | 4/2006 | Yamada et al. | |
| 2002/0024558 | A1 | 2/2002 | Fujita et al. | |
| 2002/0027574 | A1 | 3/2002 | Kao et al. | |
| 2003/0081033 | A1 | 5/2003 | Giere et al. | |
| 2004/0036726 | A1 | 2/2004 | Zach | |
| 2004/0130613 | A1 * | 7/2004 | To et al. | 347/245 |
| 2004/0246299 | A1 * | 12/2004 | Silverbrook | 347/42 |
| 2005/0068352 | A1 | 3/2005 | Smektala et al. | |
| 2005/0093900 | A1 | 5/2005 | King et al. | |
| 2005/0179712 | A1 | 8/2005 | Lee | |

FOREIGN PATENT DOCUMENTS

| | | |
|---|---|---|
| EP | 1211074 A1 | 6/2002 |
| JP | 09226163 | 9/1997 |
| JP | 11020144 | 1/1999 |

OTHER PUBLICATIONS http://graphics.kodak.com/global/consumables/plates/default.htm?CID=KNC-GSS_Keyword&SID=Google, Kodak International, pp. 1-2, Apr. 17, 2006.

http://www,ussensor.com/pgthermistors.html, U.S. Sensor Corp., pp. 1-4, Apr. 17, 2006.

* cited by examiner

*Primary Examiner*—Julian D Huffman
*Assistant Examiner*—Jason S Uhlenhake

(57) ABSTRACT

A multi-carriage printing device has a first member, a first bar mounted on the first member, and a first printer carriage mounted on the first bar. The device further has a second bar mounted on the first member, a second printer carriage mounted on the second bar, and a first temperature sensor positioned to sense a first temperature of the member.

15 Claims, 9 Drawing Sheets

MULTI-CARRIAGE PRINTING DEVICE AND METHOD

BACKGROUND

A multi-carriage printing device employs a plurality of carriages that respectively print to different portions of a print medium, e.g., paper. In this regard, each carriage has at least one print head that transfers ink onto the print medium. Oftentimes, these carriages are mounted on control bars, and each carriage moves along its respective control bar for positioning before printing. The control bars are usually coupled to and held by a pair of support members mounted on a frame of the printer.

Typically, the multiple carriages are positioned such that during printing of an image to the medium, the carriages do not have to move along the control bar. Instead, the medium on which the image is to be printed moves via, for example, a rotating drum, underneath the carriages. Thus, as the paper moves under the carriages, the print heads transfer ink onto the medium to form a desired image.

As described hereinabove, the carriages are held by a pair of support members, and such members are often made up of a material that expands and/or contracts when the temperatures in which they operate increases and/or decreases, respectively. Furthermore, the expansion and/or contraction experienced by the members are not consistent. Therefore, because the carriages are mounted on control bars that attach to the support members, when the support members expand and/or contract, such expansion and/or contraction causes the carriages to misalign. When the carriages misalign due to the expansion and/or contraction of the support members, the portion of the desired image printed by one of the carriages may not continue to be aligned with the portion of the desired image printed by the other carriage. Such misalignment affects the print quality (PQ) of the desired image.

DETAILED DESCRIPTION

Embodiments of the present disclosure generally pertain to systems and methods for dynamically calibrating a multi-carriage printer. In particular, a multi-carriage printer in accordance with an embodiment of the present disclosure comprises a plurality of control bars mounted on a support member. A respective printer carriage is mounted on each bar, and the support member fixes the carriages relative to each other.

As the temperature of the support member fluctuates, the support member may expand and/or contract causing the carriages to move with respect to one another. Such carriage movement may distort the image being printed. Thus, a temperature sensor is positioned to sense a temperature of the support member, and logic is configured to operate at least one printer carriage based on the sensed temperature. In this regard, the logic compensates for misalignment of the carriages resulting from expansion of the support member.

The multi-carriage printer in accordance with an exemplary embodiment of the present disclosure receives real-time temperature signals from at least two temperature sensors. The multi-carriage printer uses the signals to determine an offset position for printing an image to a medium to compensate for real-time expansion and/or contraction at least two support members to which the temperature sensors are coupled. In this regard, the printer uses the real-time temperatures to adjust when at least one print head fires in order to compensate for expansion and/or contraction of the support members.

Figure 1:
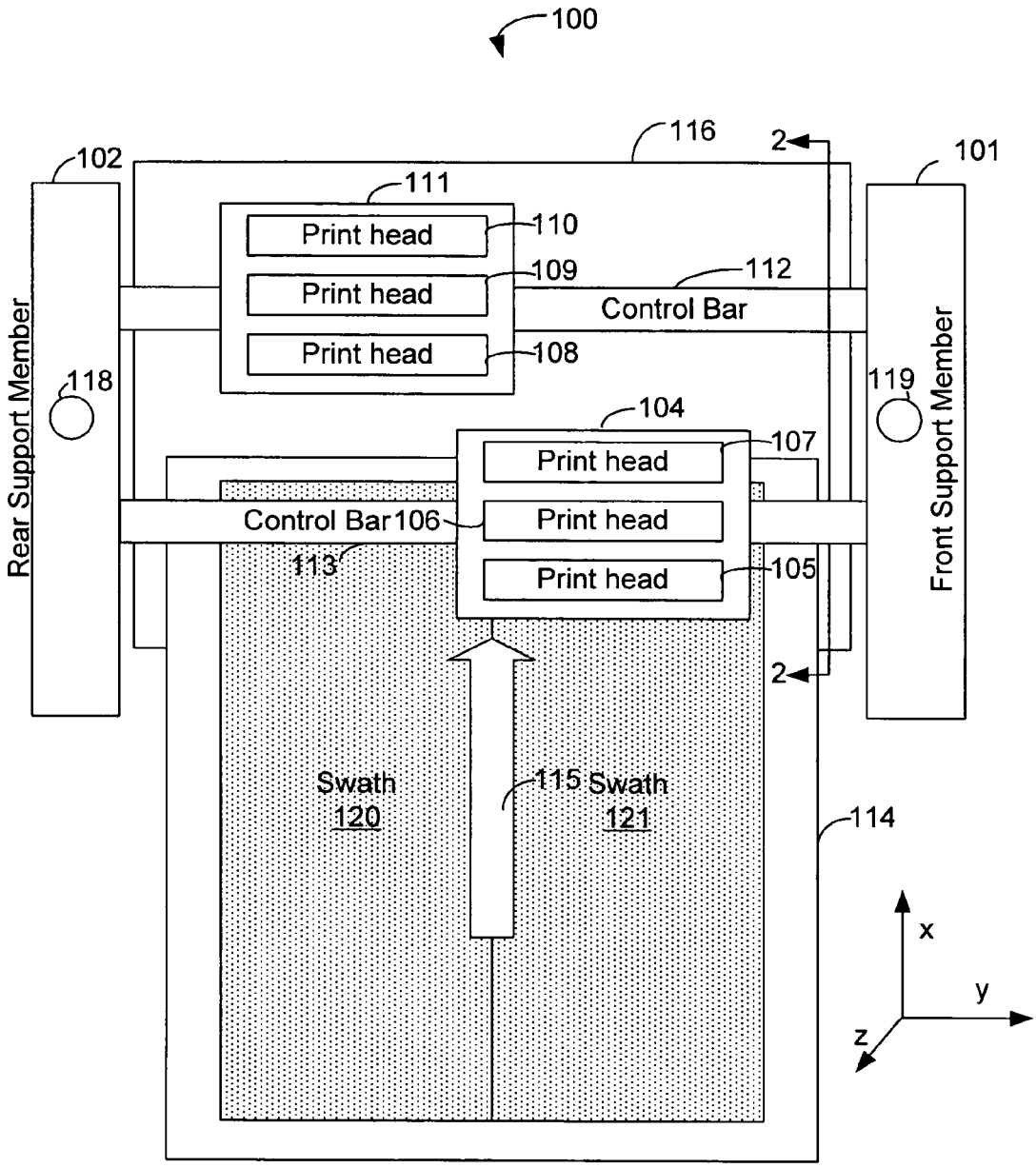
FIG. 1 is a plan view of a multi-carriage printing system in accordance with an exemplary embodiment of the present disclosure.

FIG. 1 depicts a printer 100 in accordance with an embodiment of the present disclosure. The printer 100 comprises two carriages 104 and 111. Note that for simplicity and brevity two carriages 104 and 111 are illustrated and described further herein. However, other numbers of carriages may be used to implement the printer 100 of the present disclosure. The carriages 104 and 111 are affixed to a front support member 101 and a rear support member 102 via control bars 113 and 112, respectively. Such carriages move along and are guided by the control bars 113 and 112.

Each of the carriages 104 and 111 comprises a plurality of print heads 105-107 and 108-110, respectively. Note that a print head is generally an electro-mechanical device having one or more ink sources (not shown), e.g., ink cartridges. Each print head further comprises components for receiving ink from the cartridges (not shown), for forming ink droplets, and for transferring the ink droplets to a print medium 114.

The carriages 104 and 111 move in the +/− y-direction along their respective control bars 113 and 112. Each carriage's resting position is determined by the image that is to be printed to the print medium 114, and is controlled as described further herein. Notably, however, for each page printed by the printer 100, the carriages 104 and 111 move to an initial position and remain fixed in that position while at least a portion of an image is being printed. The carriages do not move in the +/− y-direction while the portion of the image is being transferred to the medium 114 by the print heads 105-110.

In this regard, the printer 100 further comprises a drum 116. The drum 116 may be, for example, cylindrically shaped. Further, the drum 116 may be comprised of Aluminum (Al). While the carriages 104 and 111 remain fixed in their described initial positions, the drum 116 rotates moving the print medium 114 axially such that the paper passes the carriages 104 and 111 while the print heads 105-110 are transferring ink droplets to the medium 114. In this regard, a print medium 114 is fed into the printer 100 in the x-direction, and a reference arrow 115 indicates the general direction that the print medium 114 is fed into the printer 100.

Notably, in order for the printer 100 to print an entire image to the medium 114, it may be for the drum 116 to rotate the medium 114 a plurality of times thereby passing the medium 114 a plurality of times beneath the carriages 104 and 111. Depending upon the particular image that is being printed to the medium 114, each carriage 104 and 111 may print a portion of the image to the medium 114 at their indicated positions or the carriages may move to other y-positions along their respective control bars 113 and 112 to print other portions of the image.

When a user powers on the printer 100, the printer 100 performs automatic pen alignment (APA). In performing APA, the printer 100 performs a myriad of calculations for use in controlling printing by the print heads 105-107 and 108-111. In this regard, one calculation performed at APA is calculating the x-position at which each carriage 104 and 111 prints in order to ensure that the portions of the image printed by carriage 104 and 111 are aligned.

Thus, at APA the printer 100 calculates the x-position, hereinafter referred to as the "reference x-position," at which carriage 104 prints its portion of the image, hereinafter referred to as swath 121. Further, the printer 100 calculates adjusts the x-position at which carriage 111 prints its portion of the image, hereinafter referred to as swath 120, to align with the reference x-position calculated for swath 121, which is described further with reference to FIG. 4. Notably, print swaths 120 and 121, when taken together, make up substantially a portion of the image being printed to the medium 114. Note that throughout the present disclosure two swaths are described. However, any number of swaths printed by any number of carriages is possible in other embodiments.

Further, note that as the printer 100 operates, the temperatures of the front support member 101 and the rear support member 102 may increase and/or decrease. As such, the front support member 101 and the rear support member 102 may expand and/or contract, respectively. When expansion and/or contraction occur by the member 101 and 102, calculations made at APA relative to the x-positions at which the carriages 104 and 111 may no longer be effective in ensuring that swaths 120 and 121 continue to align.

At APA each of the front support member 101 and the rear support member 102 is coupled to a respective temperature sensor 118 and 119, e.g., a thermistor, respectively. During APA, the printer 100 receives a signal from each temperature sensor 119 and 118, and each signal is indicative of the temperature of the front support member 101 and the rear support member 102, respectively. Such temperatures obtained during APA are hereinafter referred to as the front support member APA temperature and the rear support member APA temperature.

The printer 100 then calculates at what x-position the print heads 108-110 print in order to ensure that printing of swath 120 occurs at the reference x-position, and the printer stores the temperatures associated with the reference x-position for use in real-time calibration, as described further herein. When performing APA, the printer calculates the APA x-position of swath 120 based upon known information. For example, the dimensions of the support members 101 and 102 may be known, and the printer 100 calculates the APA x-position based upon any differences there may be in the support members. The printer 100 determines when the print heads 108-110 should begin printing as the paper spins underneath the print heads 108-110 on the drum 116. Thus, when the printer 100 begins printing after APA, the swaths 120 and 121 are aligned at the reference x-position. Notably, determining when to print the swath 120 ensures that swath 120 and swath 121 are printed sufficiently to form the desired image without any unacceptable print quality (PQ) defects associated with differences in the support members 102 and 101 due to, for example, machining inconsistencies when the support members were manufactured.

Note that in one embodiment the support members 101 and 102 are of a predetermined shape, size, and material. For example, the support members 101 and 102 may be rectangular and comprised of aluminum.

As the printer 100 operates, the support members 101 and 102 to which the carriages 104 and 111 are coupled via the control bars 113 and 112, respectively, may experience an increase and/or decrease in temperature as described herein. Notably such increase and/or decrease in temperature may not occur consistently between the front support member 101 and the rear support member 102, thus expansion and/or contraction will not be uniform from one carriage 104 to the other 111.

When such an increase in temperature occurs, the front support member 101 and the rear support member 102 may inconsistently expand thereby causing misalignment of the carriages 104 and 111 in the x-direction, as described in more detail with reference to FIGS. 4-6. Notably, misalignment may also occur in the y-direction, however, such misalignment is insignificant for purposes of this disclosure. As an example, with misalignment in the x-direction, if the printer 100 were to print to the medium 114, swath 120 and swath 121 would not print to the medium 114 and create a quality image comprising the swaths 120 and 121. To the contrary, misalignment of the carriages 104 and 111 would introduce PQ defects in the image printed to the medium 114 due to expansion and/or contraction of the front support member 101 and the rear support member 102 after APA has been performed. In this regard, the swaths 120 and 121 would be incorrectly located in the x-direction.

In one embodiment, the carriage 104 is used as a reference to adjust the x-position of the swath 120 to account for temperature variations between the support members 101 and 102. As described hereinabove, the printer 100 calculates the reference x-position at APA.

Furthermore, the printer 100 dynamically determines the geometrical representation of the expansion and/or contraction of the front and rear support member 101 and 102. The printer 100 calculates an x-offset relative to the reference x-position of swath 120 at APA and controls firing of the print heads 108-110 to ensure that the swath 120 will align with swath 121 to form the desired image. In such an embodiment, the timing associated with firing of the print heads 108-110 is adjusted with respect to the firing of the print heads 105-107. Notably, in such an embodiment, the reference x-position remains constant, and the x-position of the swath 120 is adjusted to ensure PQ of the image being printed.

Figure 2:
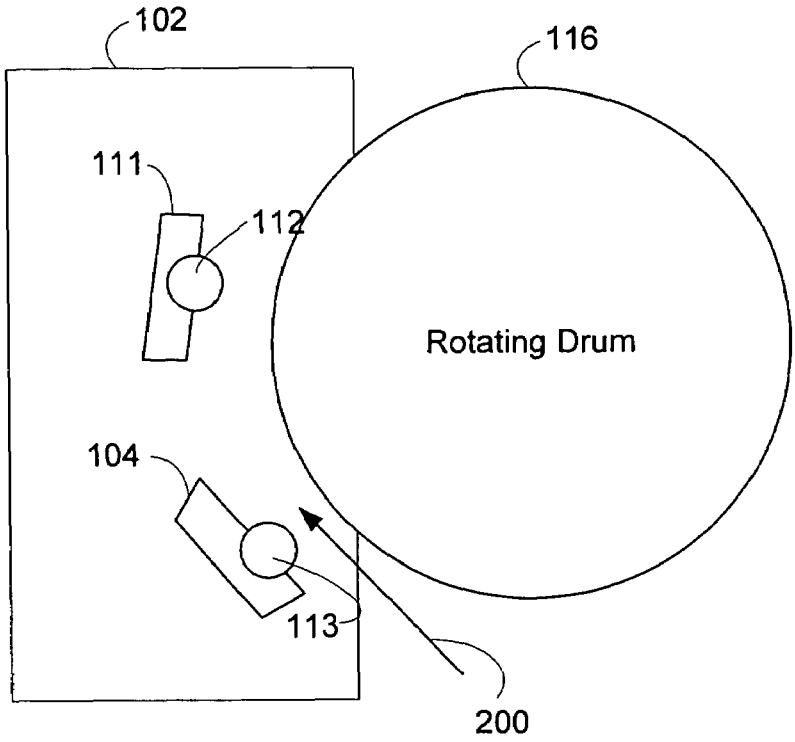
FIG. 2 depicts a cross-sectional view of the printing system depicted in FIG. 1.

FIG. 2 is a brief cross-sectional view of the printer 100. Such cross-sectional view illustrates the carriage 104 and carriage 111, each of which is respectively mounted on one of the control bars 113 and 112. As described hereinabove, a print medium 114 is fed onto the rotating drum 116 in the general direction shown by reference arrow 200. The print heads 105-107 (FIG. 1) begin printing swath 121 before the print medium 114 reaches carriage 111. Before the print heads 105-107 complete printing swath 121, the print medium 114 then passes underneath carriage 111, and the print heads 108-110 (FIG. 1) print swath 120. Therefore, the printer 100 times when the print heads 105-107 begin printing and times when the print heads 108-110 begin printing. The timing of the printing by the print heads 108-110 controls the x-position of the swath 120. In this regard, in order to move the swath 120 from its APA x-position, i.e., in the positive x-direction depending upon expansion of the members 101 and 102, the printer 100 would begin printing swath 120 earlier relative to when swath 121 is printed. Likewise, to move the swath from its APA x-position in the negative x-direction, the printer 100 would delay printing swath 120 relative to when swath 121 is printed.

Figure 3:
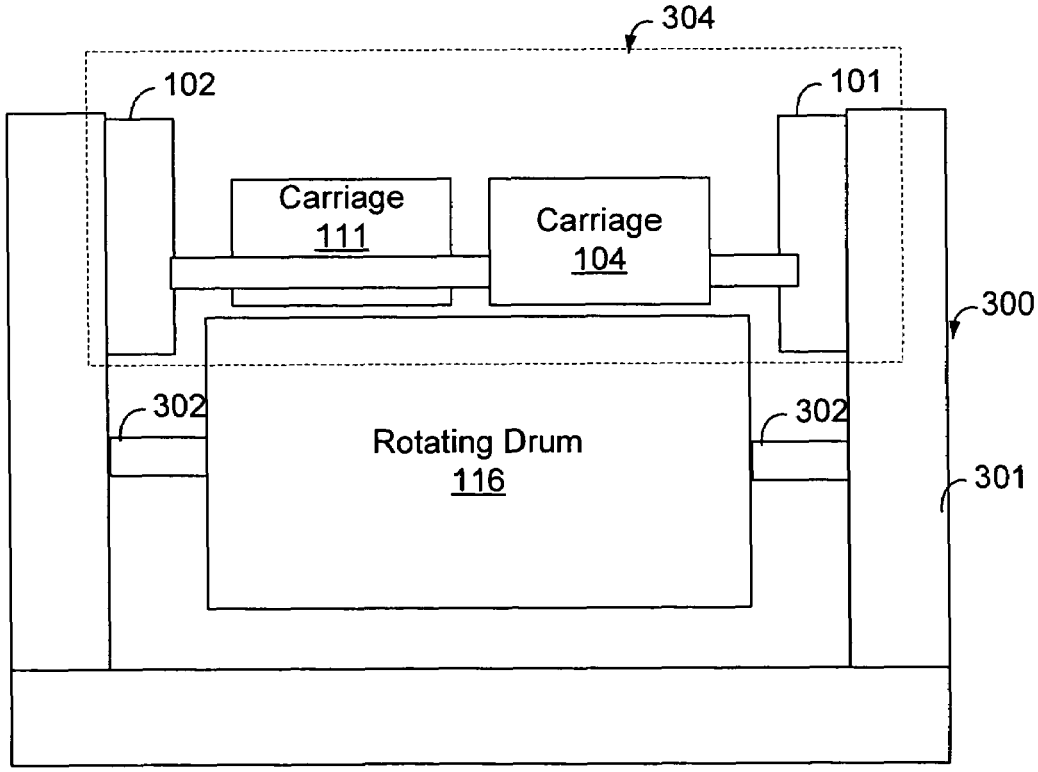
FIG. 3 depicts a side view of the exemplary printing system depicted in FIG. 1.

FIG. 3 depicts a side view of the printer 100 depicted in FIG. 1, and the support members 104 and 111 are mounted to a drum assembly 300. Notably, the drum assembly 300 comprises a base structure 301, and the drum 116 is rotatably affixed to the base structure 301 via the rods 302.

In this regard, the drum 116 rotates about an axis formed by the rods 302. As the rotating drum 116 passes paper underneath the carriages 104 and 111, carriage 104 begins printing its associated swath 121 onto the print medium 114 (FIG. 1), and at some time after, carriage 111 begins printing its associated swath 120. Thus, there is a time delay between when carriage 104 prints and when carriage 111 prints. That amount of delay is determined by the change in distance between carriage 104 and 111 as the paper passes underneath them both and the speed of the rotating drum. Nonetheless, carriage 104 begins printing, and carriage 111 begins printing such that swath 121 and swath 120 align to form a desired image.

Furthermore, a carriage assembly 304 comprises the front support member 101, the rear support member 102, the carriages 104 and 111, and the connecting rods 112 and 113. The carriage assembly 304 is mounted to the drum assembly 300. In one embodiment, the carriage assembly 304 is mounted such that direction of expansion of the support members 101 and 102 due to temperature increases of the printer 100 is limited. Such mounting is described further herein.

Figure 4:
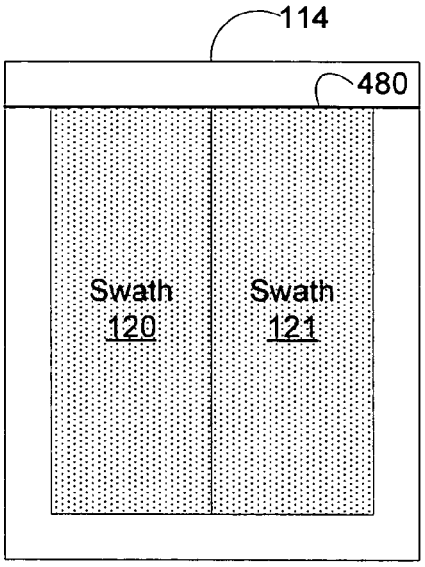
FIG. 4 depicts swaths printed by the exemplary printing system depicted in FIG. 1 when the swaths are aligned in the x-direction.

FIG. 4 depicts a medium output from the printer of FIGS. 1-3 when the carriages 104 and 111 are aligned. In this regard, "aligned" refers to the print heads 108-110 in carriage 111 configured such that they transfer ink to the medium 114 at a time sufficient to ensure that swath 120 and swath 121 are aligned to a reference x-position 480 at APA within an acceptable margin so as to result in acceptable print quality. Thus, FIG. 4 depicts a desired scenario wherein swaths 120 and 121 are aligned.

Figure 5:
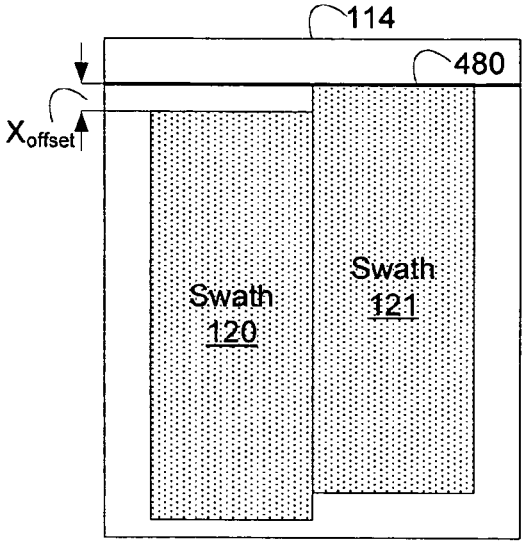
FIG. 5 depicts swaths printed by the exemplary printing system depicted in FIG. 1 when the swaths are not aligned in the x-direction.

If, however, during operation, the front support member 101 expands, the swaths 121 and 120 may misalign, such as is depicted in FIG. 5. In this regard, the distance that the swaths 120 and 121 misalign, as indicated in FIG. 5, is hereinafter referred to as the $X_{offset}$ in inches. Such misalignment is detrimental to print quality and is generally undesirable. Thus, the printer 100 dynamically determines that swaths 120 and 121 are no longer aligned at the reference x-position based upon dynamically obtained temperatures from sensors 118 and 119. The printer 100 then adjusts printing of swath 120 such that swaths 120 and 121 align as depicted in FIG. 4.

Figure 6:
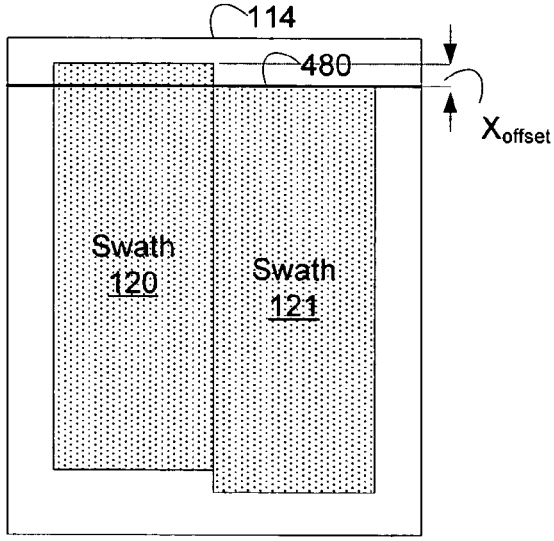
FIG. 6 depicts swaths printed by the exemplary printing system depicted in FIG. 1 when the swaths are not aligned in the x-direction.

In addition, if the rear support member 102 expands to a greater length than the front support member 101 expands, then the swaths 121 and 120 may misalign as illustrated in FIG. 6. In this regard, the swaths 120 and 121 are printed to the paper, and the distance between them is the $X_{offset}$ distance in inches. Thus, the printer 100 dynamically determines that swaths 120 and 121 are no longer aligned at the reference x-position based upon dynamically obtained temperatures from sensors 118 and 119. The printer 100 then adjusts printing of swath 120 such that swaths 120 and 121 align as depicted in FIG. 4.

Note that FIGS. 4-6 depict exemplary scenarios showing desired alignment of swaths 120 and 121 (FIG. 4), misalignment caused by movement of swath 120 in the positive x-direction (FIG. 5), and misalignment caused by movement of swath 120 in the negative x-direction (FIG. 6). Note, however, that swath 121 is the "reference swath," and any adjustment made to align swaths 120 and 121 are made so that swath 120 aligns to swath 121. In other embodiments, however, swath 121 could be used as the reference swath.

Furthermore, FIGS. 1-6 depict a printer 100 comprising two carriages 104 and 111. Note that in other embodiments, other numbers of carriages may be employed. For example, in order to print an image to an 11-inch×17-inch page, three swaths may be used and three carriages may be employed. However, in each scenario, any other swaths are aligned to a reference swath.

Figure 7:
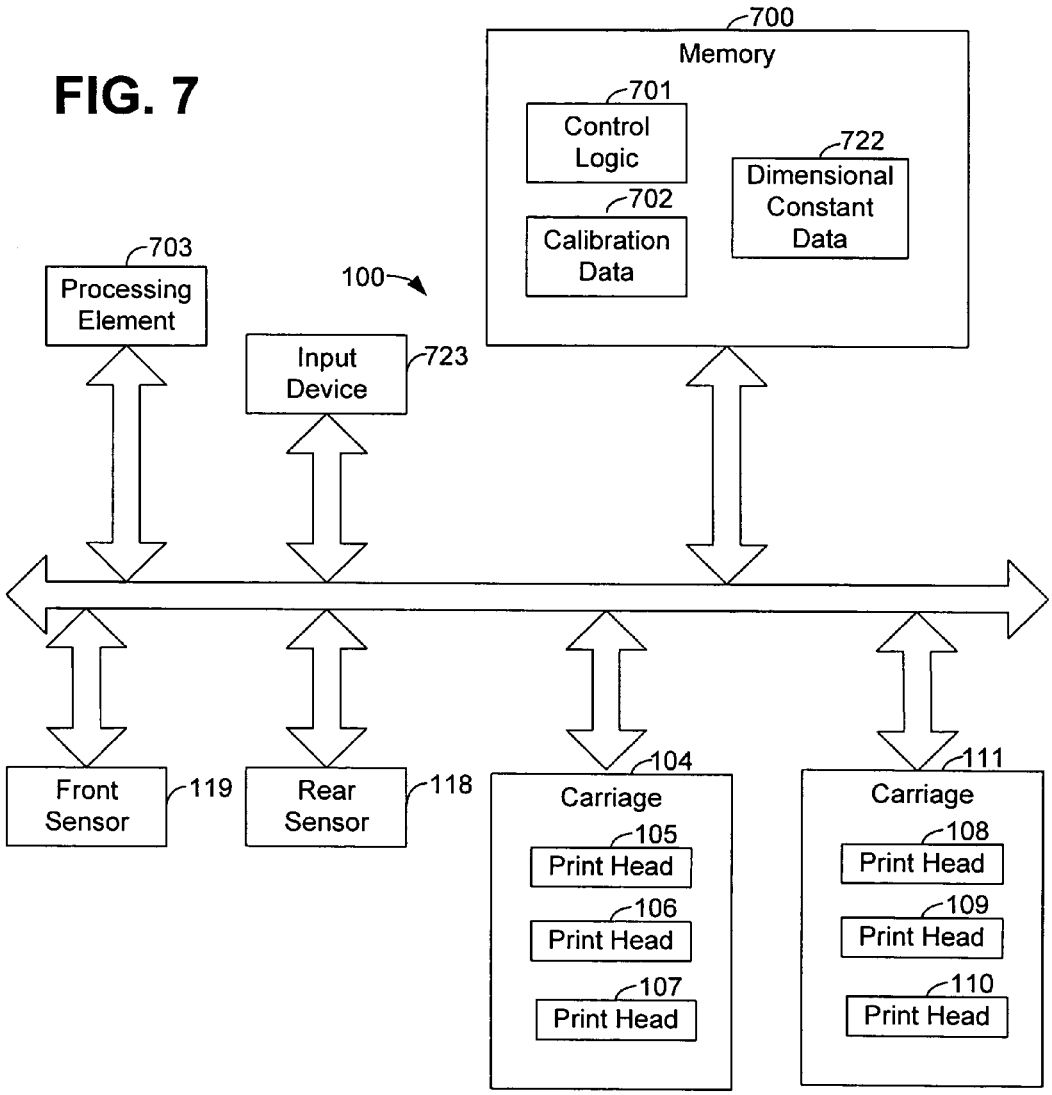
FIG. 7 depicts a block diagram illustrating the exemplary printing system depicted in FIG. 1.

FIG. 7 depicts a block diagram of the printer 100 in accordance with an exemplary embodiment of the present disclosure. The exemplary embodiment of the printer 100 depicted by FIG. 7 comprises at least one processor 703, such as a digital signal processor (DSP) or a central processing unit (CPU) and an input device 723. The processor 703 communicates with and drives the other components within the printer 100 via a local interface 707, which can include at least one bus. The input device 723 receives input from a user (not shown) and can include a keyboard, a mouse, a touch screen, or the like.

The printer 100 further comprises memory 700 for storing at least control logic 701 and calibration data 702, described further herein. As described herein with reference to FIG. 1, the printer 100 further comprises the front temperature sensor 119, the rear sensor 118, and a plurality of carriages 104 and 111. As indicated hereinabove, the printer 100 may comprises any number of carriages in other embodiments, however, for simplicity of description, two carriages 104 and 111 are illustrated and described.

As indicated hereinabove, memory 700 stores at least the control logic 701 and the calibration data 702. The control logic 701 may be implemented in hardware, software, or a combination thereof. In the exemplary embodiment illustrated in FIG. 3, the control logic 701, along with its associated methodology, is implemented in software and stored in memory 700. Note that the control logic 701, when implemented in software, can be stored and transported on any computer-readable medium for use by or in connection with an instruction execution device, such as a processor, that can fetch and execute instructions.

The control logic 701 performs initial print head alignment. The control logic 701 determines the y-position of each of the carriages 104 and 111, as described hereinabove with reference to FIG. 1. The control logic 701 performs such y-position determination by determining the width of the medium 114 (FIG. 1) then aligning the carriages 104 and 111 in relation to each other. Alignment of the carriages 104 and 111 is such that carriage 104 prints the first swath 121 and carriage 111 prints the second swath 120 such that the print heads 105-110 print their respective swaths 121 and 120 to form a single image. As noted herein, the multi-carriage printer 100 is may comprise a system in which the carriages 104 and 111 remain substantially fixed during printing of an image. The rotating drum 116 (FIG. 1) passes the medium 114 underneath the print heads 105-110 while the print heads 105-110 are transferring ink to the medium 114. Therefore, once the control logic 701 determines the y-position of each carriage 104 and 111, the carriages 104 and 111 do not substantially move from those determined y-positions during printing.

In addition, the control logic 701 calculates the beginning x-position of each swath 121 and 120. In this regard, in the embodiment that is being described, the swath 121 that is printed by the print heads 105-107 is not adjusted to account for temperature change, i.e., the beginning x-position on the medium where the print heads 105-107 begin transferring ink for swath 121 is substantially unadjusted. The control logic 701 then calculates the beginning x-position for swath 120.

In order to calculate the beginning x-position of swath 120, the control logic 701 queries and/or receives an unsolicited signal from each of the temperature sensors 118 and 119, and stores data indicative of the temperature signals received as calibration data, hereinafter $T_{rear@APA}$ and $T_{front@APA}$. The signals received are indicative of the current temperature of each of the support members 101 and 102. The printer then determines whether the carriages are in alignment using known lengths, widths, or otherwise sizes of the support members to determine whether, when the carriages 104 and 111 print an image, will the swaths 120 and 121 produced be aligned in the x-position. The control logic 701 then uses such x-position information to determine when the print heads 105-108 are to transfer ink to the medium 114 to ensure that swath 120 is appropriately aligned with swath 121.

During operation, the temperature of each support member 101 and 102 may change. In this regard, if the printer 100 is used frequently, then the temperatures are likely to increase, and as use decreases the temperatures are likely to decrease. As the temperatures increase, the support members 101 and 102 expand. Likewise, as the temperatures decrease, the support members 101 and 102 contract. As the support members 104 and 111 expand and contract, the x-position, and thus the timing of printing, at APA originally calculated for swath 120 may no longer be valid. Therefore, the control logic 701 receives the temperature signals from the temperature sensors 119 and 118 and uses such information to determine when the print heads 108-109 fire in order to offset for expansion and/or contraction resulting from increased temperature of the printer 100. The printer 100 then calculates the $X_{offset}$ from the x-position at APA or the x-position to which the swath 120 was previously moved for printing. The control logic 701 then uses the $X_{offset}$ to determine an adjusted x-position to compensate for the separation of the carriages 104 and 111 due to expansion and/or contraction resulting from temperature increases of the front support member 101 and the rear support member 102. Thus, there are not PQ defects in the desired image when it is printed to the medium 114.

Thus, the control logic 701 aligns the print heads 105-107 and 108-110 by adjusting the timing of when the print heads 108-110 transfer their swath 120 to the medium 114 using swath 121 as a reference. The control logic 701 stores data indicative of the initial temperatures of the support members 101 and 102 at APA that are used to determine the initial x-position of swath 120. As the printer 100 prints, the control logic 701 receives data from the temperature sensors 118 and 119 indicative of real-time temperatures of the support members 101 and 102. The control logic 701 then uses the real-time temperatures to calculate the effects of expansion and/or contraction on the shape and/or length of the support members 101 and 102. The control logic 701 then adjusts the timing of the transfer of ink by the print heads 108-110 by calculating an $X_{offset}$ value to apply to swath 121 to compensate for the expansion and/or contraction in the support members 101 and 102. Effectively, the control logic 701 moves the swath 120 relative to the x-position at APA. Thus, the control logic 701 real-time calibrates the x-position alignment of the swaths 121 and 120 based upon temperature changes in the support members.

Figure 9:
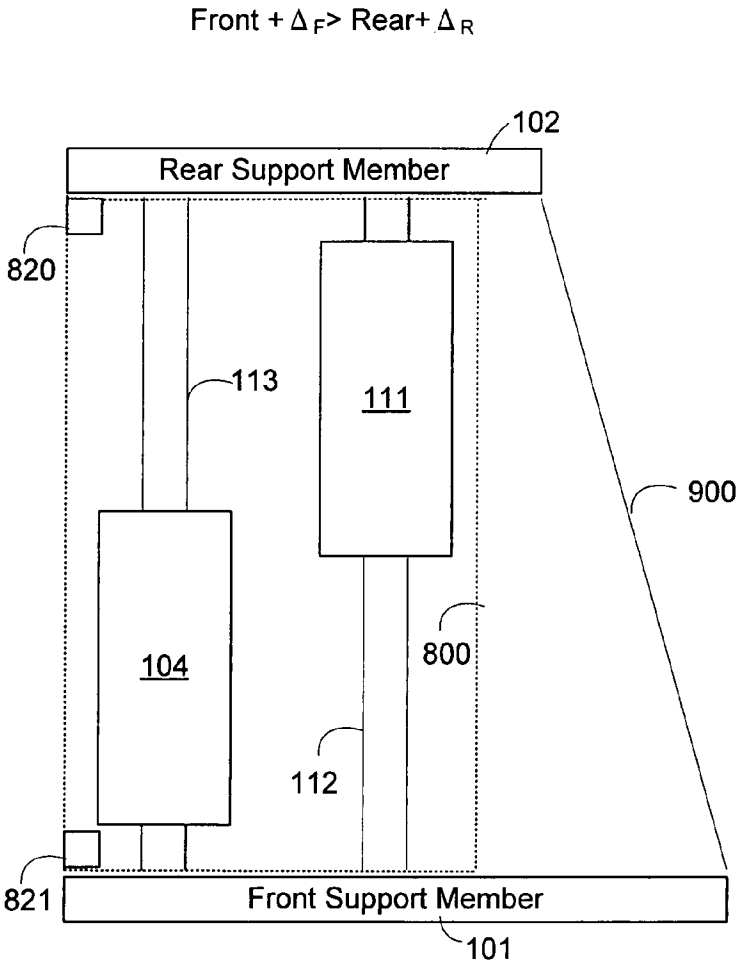
FIG. 9 is a block diagram illustrating alignment of carriages of the printing system depicted in FIG. 1 when the length of a front support member is greater than the length of a rear support member resulting from expansion.
Figure 8:
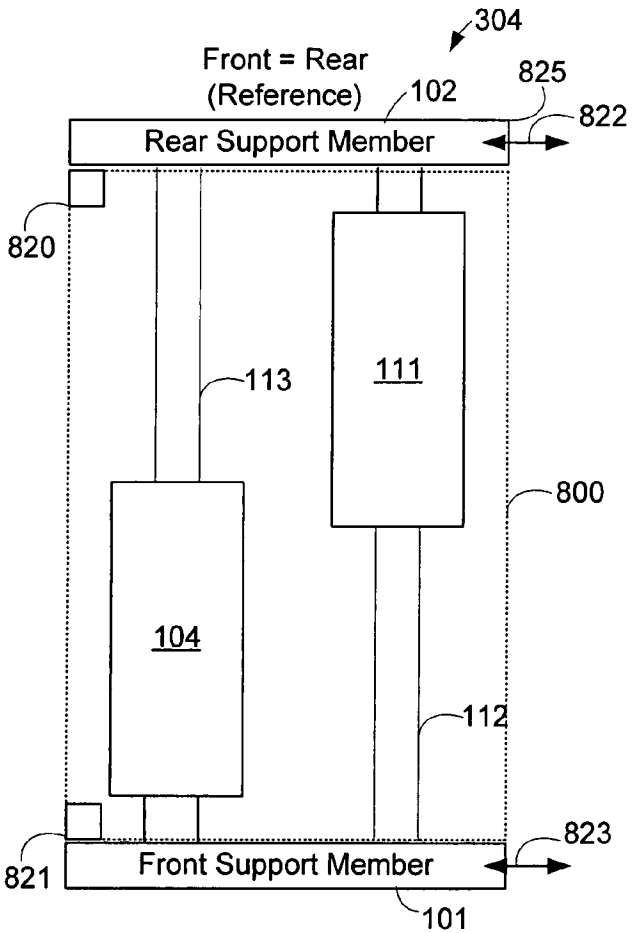
FIG. 8 is a block diagram illustrating alignment of carriages of the exemplary printing system depicted in FIG. 1 when no expansion and/or contraction has affected the carriage's alignment.
Figure 10:
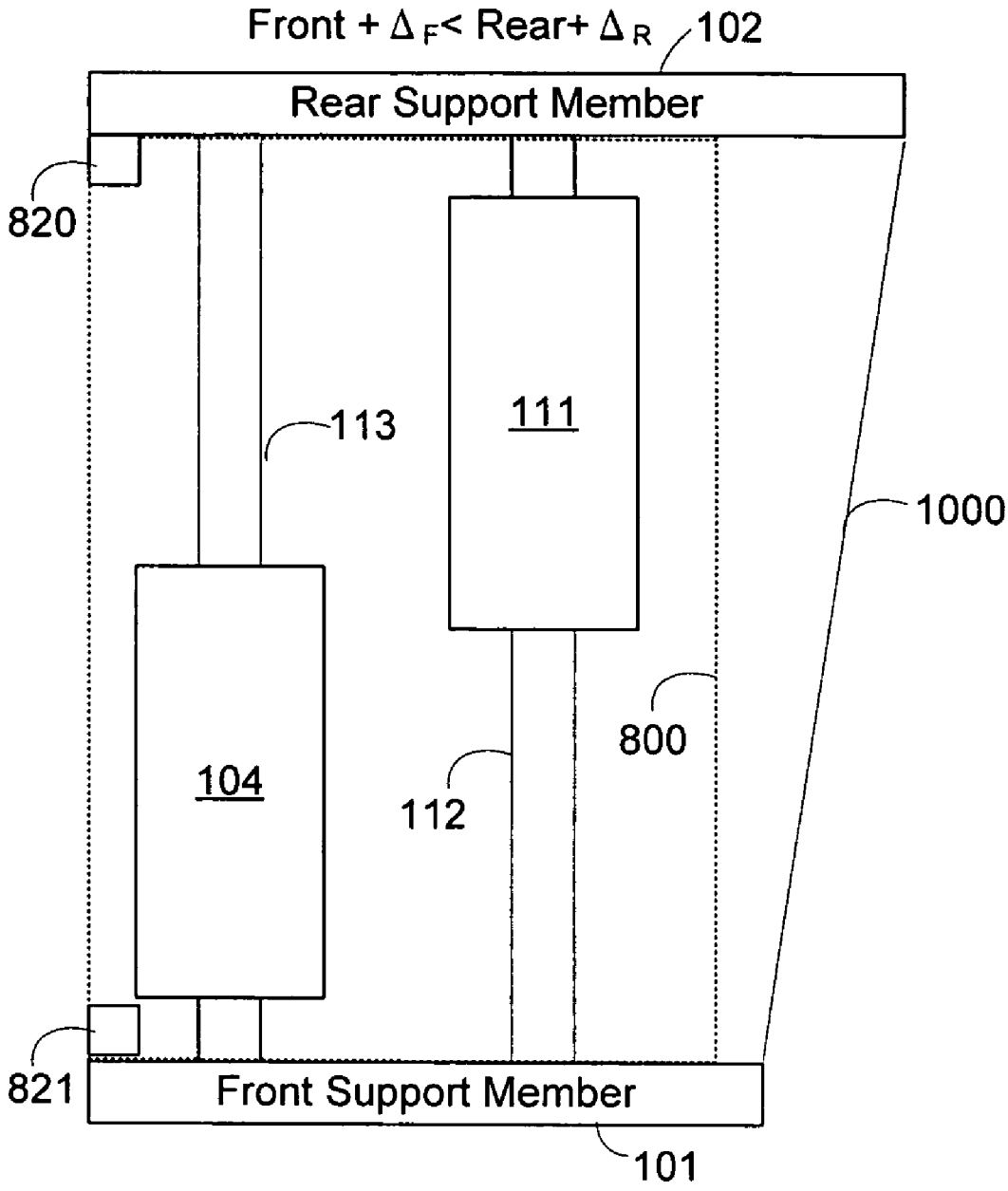
FIG. 10 is a block diagram illustrating alignment of carriages of the printing system depicted in FIG. 1 when the length of a front support member is less than the length of a rear support member resulting from expansion.

FIGS. 8-10 depict three cases representing relative alignment of support members 101 and 102. In this regard, there may be additional cases possible, however, FIGS. 8-10 represent exemplary possibilities.

FIG. 8 depicts a planar top view of the carriage assembly 304 of the printer 100 (FIG. 1). FIG. 8 depicts the carriage assembly 304 when the front support member 101 and the rear support member 102 are substantially equal in length. Thus, when members 101 and 102 are aligned, a rectangle 800 depicts their alignment relationship. In this regard, the rectangle 800 is orthogonal to the facing surfaces of both members 101 and 102.

As described hereinabove, the support members 101 and 102 are affixed to the drum assembly 300 (FIG. 3). However, the members 101 and 102 are affixed to the drum assembly 300 such that the members 101 and 102 can expand and/or contract in the +/− x-direction along reference arrows 822 and 823. In this regard, ends 826 and 827 of the members 101 and 102 may expand in the +/− x-direction, however, the opposing ends of the members 101 and 102 are affixed so that expansion and/or contraction is limited to ends 826 and 827.

Thus, as the temperature of the printer 100 increases, the support structures 101 and 102 expand in the direction indicated by the reference arrows 822 and 823. In this regard, because the carriage assembly 304 is mounted to the drum assembly, the support structures 101 and 102 are limited in their degree of freedom to the directions indicated by reference lines 822 and 823. Such expansion is shown and described in more detail with reference to FIGS. 9 and 10.

Further, as the temperature of the printer 100 decreases, the support structures 101 and 102 contract in the direction indicated by the reference arrows 822 and 823. In this regard, because the carriage assembly 304 is mounted to the drum assembly, the support structures 101 and 102 are limited in their degree of freedom to the directions indicated by reference lines 822 and 823.

Notably, at APA the support members 101 and 102 may not have been equal in length. Therefore, during operation, the control logic 701 may determine that a change in temperature of members 101 and/or 102 indicates a deviation from APA. If so, the control logic may calculate an $X_{offset}$ to apply to carriage 111 in order to ensure that swath 120 (FIG. 1) aligns with swath 121, and adjust ink transfer accordingly, as described hereinabove.

FIG. 9 illustrates a case where the front support member 101 and the rear support member 102 have each expanded in length, but have expanded inconsistently. In this regard, the front support member 101 has expanded more than the rear support member 102. A reference line 900 illustrates the difference between the two support members 101 and 102.

In such a scenario, the control logic 701 calculates the $X_{offset}$ to be applied to the print heads 108-110 (FIG. 1) of carriage 111 in order to ensure that swath 121 and swath 120 still align to create an image on the medium 114 despite the inconsistent expansions experienced by the support members 101 and 102. Calculation of the $X_{offset}$ for such a case is described further with reference to FIG. 11.

FIG. 10 illustrates a case where the front support member 101 and the rear support member 102 have each expanded in length, but have expanded inconsistently. In this case, the rear support member 102 has expanded more than the front support member 101. A reference line 1000 illustrates the difference between the two support members 101 and 102. Similar to the scenario of FIG. 9, the control logic 701 calculates the $X_{offset}$ that is to be applied to the print heads 108-110 (FIG. 1) of carriage 111 in order to ensure that swath 121 and swath 120 still align to create an image on the medium 114 without PQ defects. Calculation of the $X_{offset}$ for such a case is described further with reference to FIG. 12.

Note that FIGS. 9 and 10 depict cases showing relative location and/or alignment of the support members 101 and 102 resulting from expansion of the members 101 and 102. However, other cases are possible. For example, at APA the printer 100 may exhibit a greater temperature than dynamically calculated and the members 101 and 102 may be contracted when dynamically adjusted.

Figure 11:
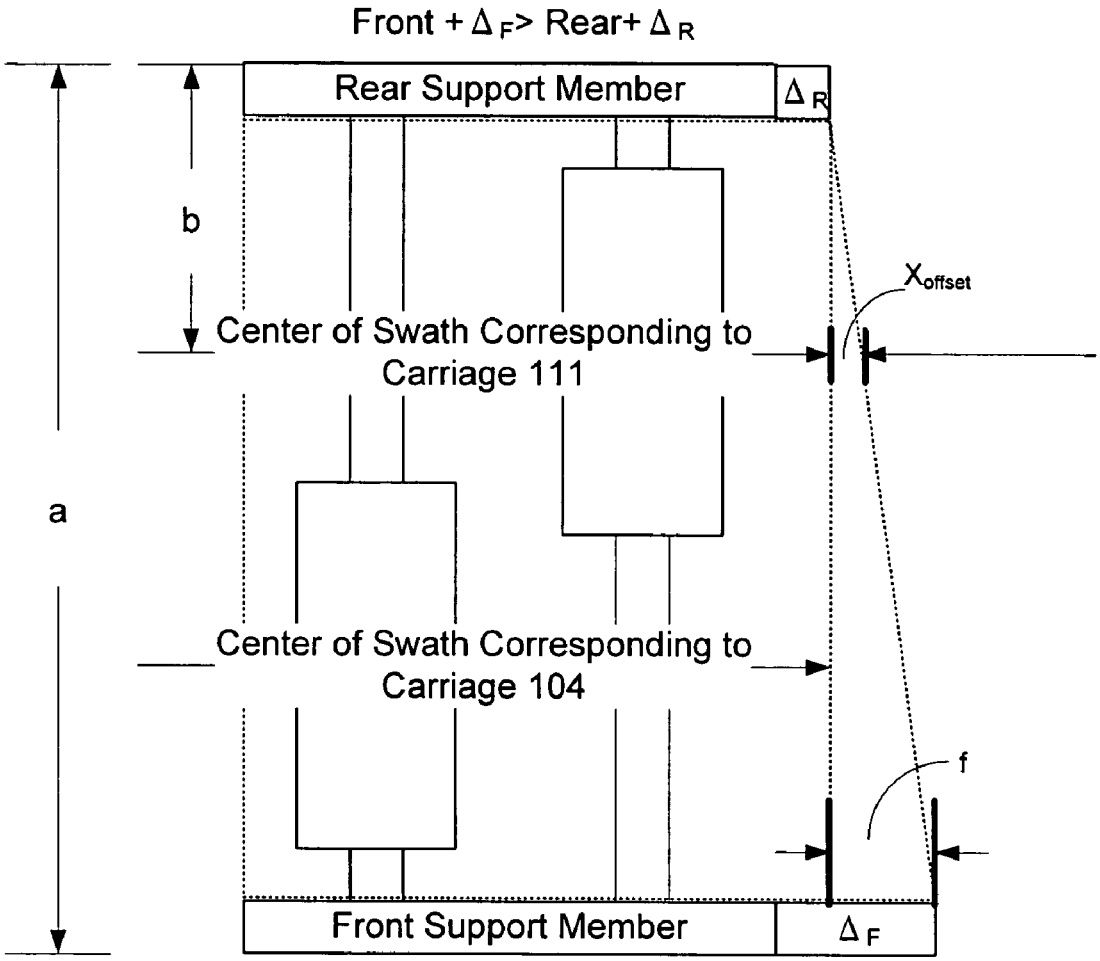
FIG. 11 is a block diagram illustrating a geometric representation of the misalignment depicted in FIG. 9.
Figure 12:
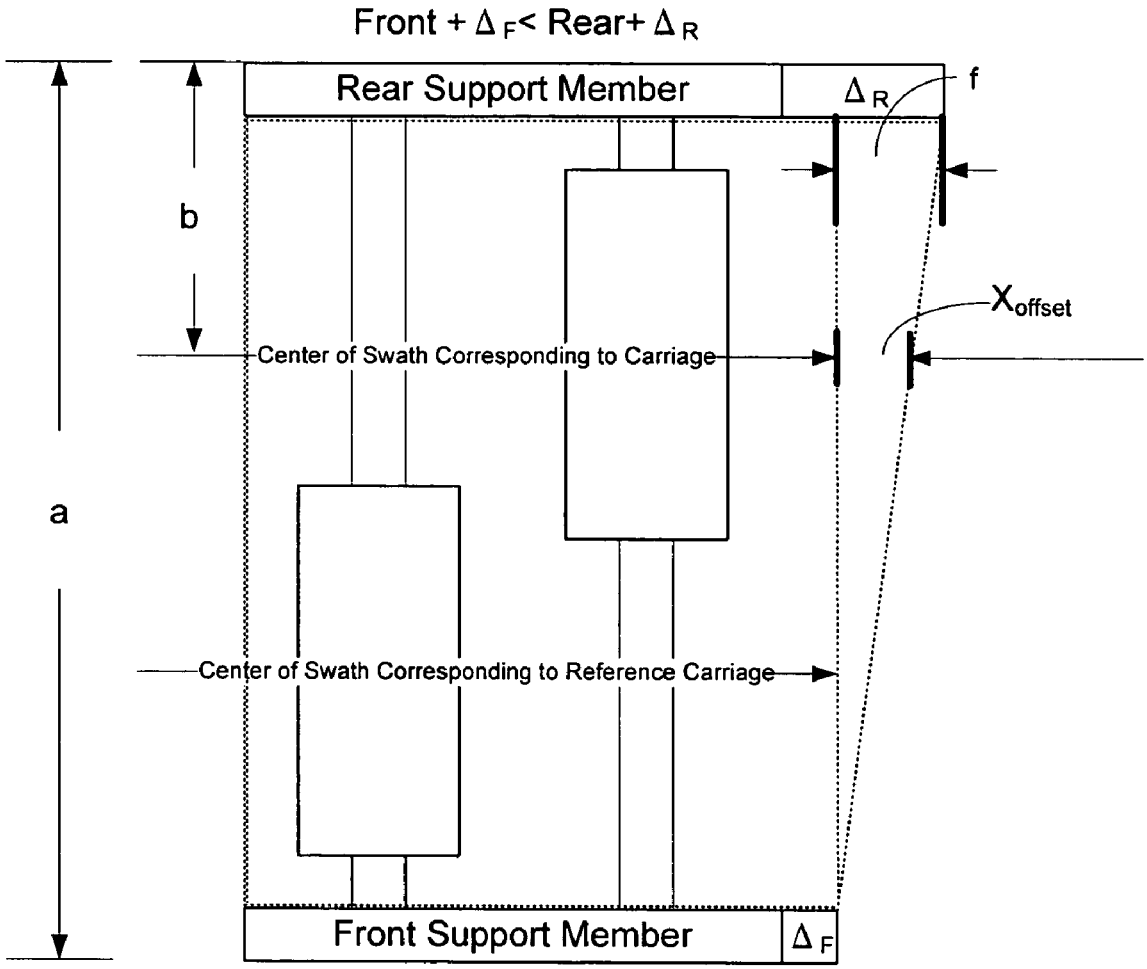
FIG. 12 is a block diagram illustrating a geometric representation of the misalignment depicted in FIG. 10.

FIGS. 11 and 12 depicts cases in which non-uniform expansion occurs in the members 101 and 102 relative to APA. Note that uniform expansion, uniform contraction, and/or non-uniform contraction relative to APA may also occur, however for exemplary purpose non-uniform expansion is described.

FIG. 11 depicts a geometric representation of the case illustrated in FIG. 9. In such a depiction, the front support member 101 has expanded in length $\Delta_F$, and the rear support member 102 has expanded in length by $\Delta_R$, where $\Delta_F$ is greater than $\Delta_R$. Thus, $\Delta_F$ and $\Delta_R$ are hereinafter referred to as thermal "transition variables." Such transition variables are calculated using the numerical differences between a real-time temperature of the front support member 101 and the temperature at APA of the front support member 101, hereinafter referred to as "$\Delta_S$," and/or a real-time temperature difference of the rear support member 102 and the temperature at APA of the rear support member 102, hereinafter referred to as "$\Delta_T$."

In this regard, $\Delta_F$ may be calculated as follows:

$$\Delta_F = m * \Delta_S * TCE,$$

where m is the distance between the control bars 113 and 112 in the x-direction, $TCE_{AL}$ is the temperature coefficient of expansion of the material of the members 101, and $\Delta_S$ may be represented by the following formula:

$$\Delta_S = \text{Temp}_{front@real\text{-}time} - \text{Temp}_{front@APA}.$$

In this regard, $\Delta_R$ may be calculated as follows:

$$\Delta_R = m * \Delta_T * TCE,$$

where m is the distance between the control bars 113 and 112 in the x-direction, TCE is the temperature coefficient of expansion of the material of the member 102, and $\Delta_T$ may be represented by the following formula:

$$\Delta_T = \text{Temp}_{rear@real\text{-}time} - \text{Temp}_{rear@APA}.$$

As noted hereinabove, data indicative of the dimensions of the printer 100 are stored as dimensional constant data 722 (FIG. 7). In one embodiment, these dimensional constants defining the dimensions of the printer 100 may be programmable via the input device 723 (FIG. 7), as described hereinabove.

Once $\Delta_F$ and $\Delta_R$ have been calculated, an $X_{offset}$ is calculated. In order to calculate the $X_{offset}$ transition variables are determined that query $\Delta_F$ and $\Delta_R$ to define what route the changed mechanical structure uses for a mathematical formula. In this regard, If $\Delta_F$ is greater than $\Delta_R$, then the transition variables are such that $$\text{Max} = \Delta_F,$$

$$\text{Min} = \Delta_R.$$

However, If $\Delta_R$ is greater than and equal to $\Delta_F$, then the transition variables are such that $$\text{Max} = \Delta_R,$$

$$\text{Min} = \Delta_F.$$

Furthermore, "f" as indicated in FIG. 11 may be calculated as follows:

$$f = \text{Max} - \text{Min}.$$

In addition, if $\Delta_F$ is greater than $\Delta_R$ as shown in FIG. 11, then the swath positional $X_{offset}$ is calculated as follows:

$$X_{offset} = [\text{Min} + f * (b/a)] * p$$

where the constant "b" represents the distance in inches from the rear support member 102 to the center of the carriage 111, and the constant "a" represents the distance in inches from the rear support member 102 to the front support member 101. Further, the constant "p" is the projection ratio to the circumference of the drum 116 (FIGS. 1 and 2). Note that as described hereinabove, there are a number of programmable constants, e.g., a, b, p, and m, that may be saved as dimensional constant data 722 (FIG. 7).

Note that the projection ratio "p" is calculated based upon the geometry of a print head 108-110 wrapping around the drum 116. In this regard, each print head 108-110 is positioned around the circumference of the drum 116, and the expanding and/or contracting of the support members 118 and 119 occurs in the x-direction indicated in FIG. 1. The projection ratio "p" compensates for the actual movement of the print head 108-110 in the "projected-x-direction" on the drum 116, which is effectively a projected arc on the cylindrical drum's circumference.

If $\Delta_R$ is greater than and equal to $\Delta_F$ as shown in FIG. 12, then the swath positional $X_{offset}$ is calculated as follows:

$$X_{offset} = [\text{Min} + f * (a - b)/a] * p$$

where the constant "b" represents the distance in inches from the rear support member 102 to the center of the carriage 111, and the constant "a" represents the distance in inches from the rear support member 102 to the front support member 101. Further, the constant "p" is the projection ratio to the circumference of the drum 116 (FIGS. 1 and 2). Note that as described hereinabove, there are a number of programmable constants, e.g., a, b, p, and m, that may be saved as dimensional constant data 722 (FIG. 7).

Figure 13:
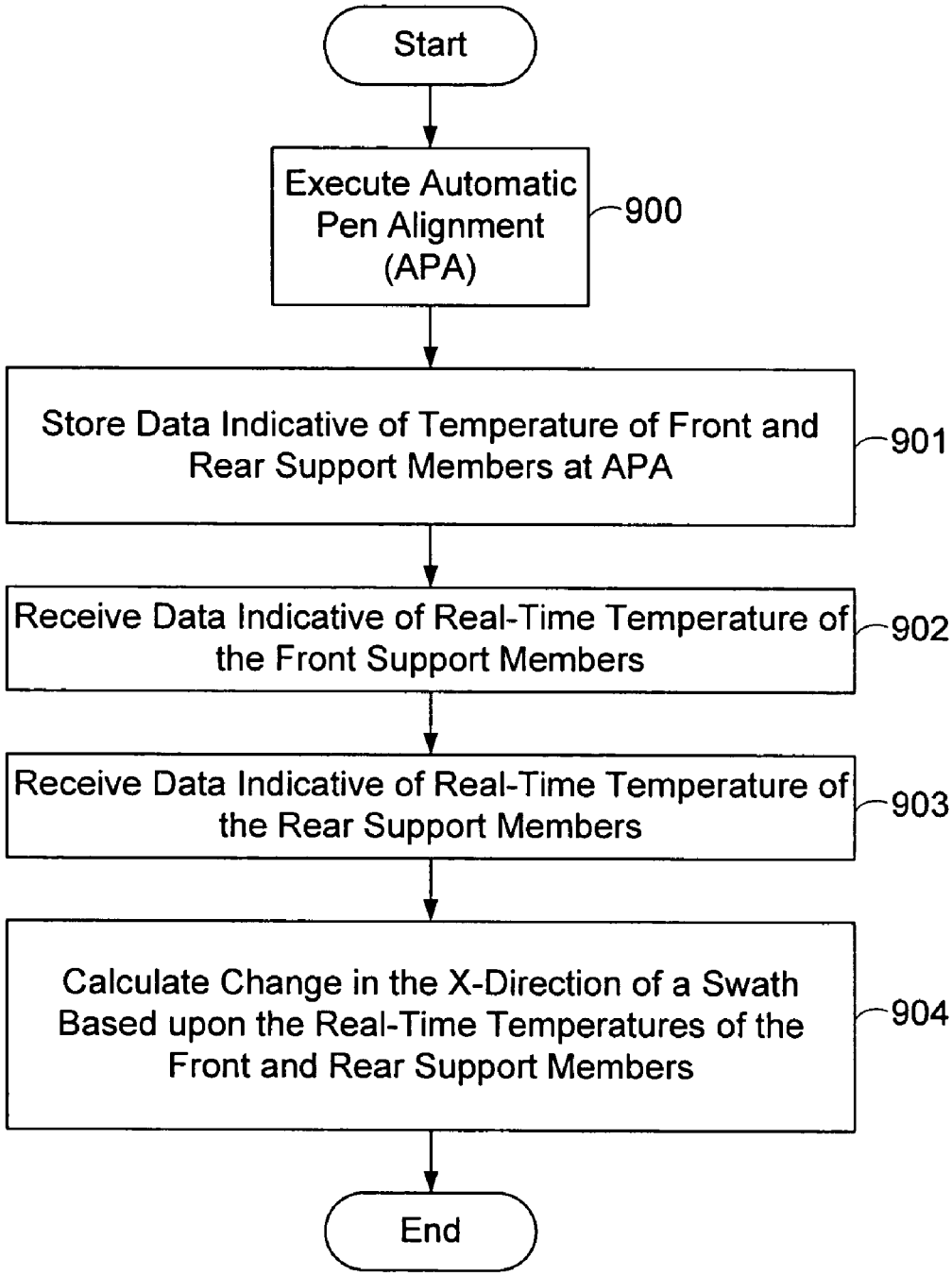
FIG. 13 is a flowchart illustrating exemplary functionality of the control logic depicted in FIG. 3.

FIG. 13 depicts exemplary architecture and functionality for the calibration performed by the control logic 701.

The control logic 701 performs automatic print head alignment (APA), as indicated in step 900. In this regard, the control logic 701 calculates the real-time sizes of the front support member 101 and the rear support member 102 at the time of APA by querying the temperature sensors 119 and 118. The control logic 701 then calculates the real-time sizes of the front support member 101 and the rear support member 102 using the received real-time temperatures of the support members 101 and 102.

The control logic 701 stores data indicative of the APA temperatures of the front support member 101 and the rear support member 102, as indicated in step 901. Such data is stored in the calibration data 702, as described hereinabove.

During operation of the printing device 100 (FIG. 1), the control logic 701 receives data indicative of the real-time temperature of the front support member 101 and the rear support member 102, as indicated in steps 902 and 903, respectively. Note that in one embodiment, the control logic 701 queries the temperature sensors 119 and 118 before printing an image to each medium 114. However, in other embodiments, the sensors 119 and 118 may transmit unsolicited signals, which the control logic 701 stores in the calibration data 702.

The control logic 701 then calculates a change in the x-direction of the swath 120 based upon the real-time temperatures of the front support member 101 and the rear support member 102, as indicated in step 904. In this regard, the control logic 701 uses the calculated change in the x-direction to determine when swath 120 prints its image. Thus, the control logic 701 uses the calculated x-direction to substantially line up swaths 120 and 121.

This disclosure describes the invention in detail using illustrative embodiments. However, the invention defined by the appended claims is not limited to the precise embodiments described.

The invention claimed is:

1. A multi-carriage printing device, comprising:
a first member;
a first bar mounted on the first member;
a first printer carriage mounted on the first bar;
a second bar mounted on the first member;
a second printer carriage mounted on the second bar;
a first temperature sensor positioned to sense a temperature of the first member; and
logic configured to calculate a reference position of the first carriage and a position of the second carriage relative to the first carriage based upon the temperature of the first member such that a first swath printed by the first carriage substantially aligns with a second swath printed by the second carriage.

2. The device of claim 1, wherein the logic is further configured to adjust when a print head of the second carriage prints an image based on a signal received from the first temperature sensor indicative of the temperature of the first member.

3. The device of claim 1, wherein the logic is further configured to receive a first temperature signal from the first temperature sensor indicative of the temperature of the first member, and to store data indicative of the temperature of the first member in memory.

4. The device of claim 3, wherein the logic is further configured to receive a second temperature signal from the first temperature sensor, a difference in the first temperature signal and the second temperature signal representing a change in the temperature of the first member.

5. The device of claim 4, wherein the logic is further configured to print an image based upon the change in temperature of the first member.

6. The device of claim 4, wherein the logic is further configured to adjust when an image is printed by a print head of the first carriage based upon the change in temperature of the first member.

7. The device of claim 1, further comprising a second member, the first bar mounted on the second member and the second bar mounted on the second member.

8. The device of claim 7, further comprising a second temperature sensor positioned to sense a temperature of the second member.

9. The device of claim 8, wherein a change in the temperature of the second member or a change in the temperature of the first member causes the first carriage to move relative to the second carriage.

10. The device of claim 9, further comprising logic configured to control operation of the first or second printer carriage based upon the change in the temperature of the second member or the change in the temperature of the first member.

11. The device of claim 10, wherein the logic is further configured to calculate when the first printer carriage prints a first swath relative to when the second printer carriage prints a second swath such that the first and second swaths are substantially aligned.

12. The device of claim 1, wherein the logic is further configured to adjust the position of the second carriage based upon a change in the temperature of the first member.

13. A method, comprising:
storing data indicative of a first temperature of a member, the member coupling a first carriage to a second carriage;
receiving a signal indicative of a second temperature of the member from a temperature sensor;
calculating when the second carriage prints relative to the first carriage based upon the first temperature and the second temperature.

14. The printer method of claim 13, further comprising printing a portion of an image based upon the calculating step.

15. A multi-carriage printing device, comprising:
a first member;
a first bar mounted on the first member;
a first printer carriage mounted on the first bar;
a second bar mounted on the first member;
a second printer carriage mounted on the second bar;
a first temperature sensor positioned to sense a temperature of the first member; and
logic configured to adjust when a print head of the second carriage prints an image based on a signal received from the first temperature sensor indicative of the temperature of the first member.

* * * * *